US009989917B1

(12) United States Patent
Hale et al.

(10) Patent No.: US 9,989,917 B1
(45) Date of Patent: Jun. 5, 2018

(54) TONER CARTRIDGE WITH POSITIONAL CONTROL FEATURES

(71) Applicant: LEXMARK INTERNATIONAL, INC., Lexington, KY (US)

(72) Inventors: Jason Paul Hale, Pembroke Pines, FL (US); Kyle Bradley Martin, Lexington, KY (US); Jeremy Keith Payne, Georgetown, KY (US); Matthew Lee Rogers, Lexington, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days. days.

(21) Appl. No.: 15/597,714

(22) Filed: May 17, 2017

(51) Int. Cl.
*G03G 21/18* (2006.01)
*G03G 15/08* (2006.01)
*G03G 21/16* (2006.01)

(52) U.S. Cl.
CPC ..... *G03G 21/1842* (2013.01); *G03G 15/0865* (2013.01); *G03G 21/1647* (2013.01); *G03G 21/1864* (2013.01)

(58) Field of Classification Search
CPC ..... G03G 21/1821; G03G 21/1842; G03G 21/1857; G03G 21/1864
See application file for complete search history.

(56) References Cited

U.S. PATENT DOCUMENTS

| | | | |
|---|---|---|---|
| 5,581,328 | A | 12/1996 | Yashiro |
| 5,758,233 | A | 5/1998 | Coffey et al. |
| 5,768,661 | A | 6/1998 | Coffey et al. |
| 6,014,536 | A | 1/2000 | Ban et al. |
| 6,070,029 | A | 5/2000 | Nishiuwatoko et al. |
| 6,463,233 | B2 | 10/2002 | Kojima et al. |
| 6,697,578 | B2 | 2/2004 | Watanabe et al. |
| 6,738,589 | B2 | 5/2004 | Karakama et al. |
| 6,771,922 | B2 | 8/2004 | Blanck et al. |
| 6,782,219 | B2 | 8/2004 | Yoshino et al. |
| 7,139,510 | B2 | 11/2006 | Carter et al. |

(Continued)

FOREIGN PATENT DOCUMENTS

| | | | |
|---|---|---|---|
| CN | 1841231 | A | 10/2006 |
| CN | 102262387 | A | 11/2011 |

(Continued)

*Primary Examiner* — Carla Therrien
(74) *Attorney, Agent, or Firm* — Justin M. Tromp

(57) ABSTRACT

A toner cartridge according to one embodiment includes a housing having first and second alignment guides that extend outward from a first side and a second side of the housing, respectively, and that run along a front-to-rear dimension of the housing. Third and fourth alignment guides extend outward from the first side of the housing. The third alignment guide is spaced toward the front of the housing from the fourth alignment guide. Bottom surfaces of the third and fourth alignment guides are unobstructed to sit on top of a corresponding guide surface in an image forming device to control a vertical position of the toner cartridge in the image forming device. The bottom surfaces of the third and fourth alignment guides are aligned with each other in a vertical dimension of the housing and are positioned higher than the first and second alignment guides.

28 Claims, 13 Drawing Sheets

(56) References Cited

U.S. PATENT DOCUMENTS

| | | | | |
|---|---|---|---|---|
| 7,305,204 | B2 | 12/2007 | Carter et al. | |
| 7,447,464 | B2 | 11/2008 | Miller | |
| 7,486,910 | B2 | 2/2009 | Kitozaki | |
| 7,548,710 | B2 | 6/2009 | Gayne et al. | |
| 7,606,520 | B2 | 10/2009 | Dawson | |
| 7,672,624 | B2 | 3/2010 | Dawson et al. | |
| 8,078,088 | B2 | 12/2011 | Sato | |
| 8,867,970 | B2 | 10/2014 | Acosta et al. | |
| 9,104,135 | B2 | 8/2015 | Hackney | |
| 9,360,834 | B1 * | 6/2016 | Payne | G03G 21/1867 |
| 9,417,603 | B2 | 8/2016 | Acosta et al. | |
| 2003/0091361 | A1 | 5/2003 | Noda et al. | |
| 2004/0105699 | A1 | 6/2004 | Kubota | |
| 2005/0135838 | A1 | 6/2005 | Miller | |
| 2005/0191091 | A1 | 9/2005 | Isobe et al. | |
| 2005/0201773 | A1 | 9/2005 | Matsubara et al. | |
| 2006/0029423 | A1 | 2/2006 | Shiraki | |
| 2006/0062589 | A1 | 3/2006 | Sasaki et al. | |
| 2006/0067725 | A1 | 3/2006 | Miyabe et al. | |
| 2006/0140664 | A1 | 6/2006 | Takami | |
| 2006/0228127 | A1 | 10/2006 | Miyabe et al. | |
| 2007/0140725 | A1 | 6/2007 | Kamimura | |
| 2007/0212118 | A1 | 9/2007 | Nagae et al. | |
| 2007/0223965 | A1 | 9/2007 | Takagi | |
| 2008/0101821 | A1 | 5/2008 | Gayne et al. | |
| 2008/0260421 | A1 | 10/2008 | Mase | |
| 2009/0142103 | A1 | 6/2009 | Chaudhuri et al. | |
| 2010/0054814 | A1 | 3/2010 | Sakurai et al. | |
| 2010/0221039 | A1 | 9/2010 | Kawai et al. | |
| 2011/0158684 | A1 | 6/2011 | Sato | |
| 2013/0170868 | A1 * | 7/2013 | Acosta | G03G 15/0886 399/258 |
| 2014/0003841 | A1 * | 1/2014 | Kobayashi | G03G 15/757 399/167 |
| 2016/0179053 | A1 * | 6/2016 | Boettcher | G03G 21/1878 399/111 |
| 2016/0231698 | A1 * | 8/2016 | Miyoshi | G03G 21/1842 |
| 2017/0108827 | A1 * | 4/2017 | Kusano | G03G 21/1842 |

FOREIGN PATENT DOCUMENTS

| | | | |
|---|---|---|---|
| EP | 0331324 | A2 | 9/1989 |
| EP | 1939695 | A2 | 7/2008 |
| JP | 02-042454 | A | 2/1990 |
| JP | 03-134674 | A | 6/1991 |
| JP | 05-119550 | A | 5/1993 |
| JP | 11-153904 | A | 6/1999 |
| JP | 2005-134725 | A | 5/2005 |
| JP | 2008-134570 | A | 12/2008 |
| JP | 2009-169117 | A | 7/2009 |

* cited by examiner

TONER CARTRIDGE WITH POSITIONAL CONTROL FEATURES

CROSS REFERENCES TO RELATED APPLICATIONS

None.

BACKGROUND

1. Field of the Disclosure

The present disclosure relates generally to image forming devices and more particularly to a toner cartridge having positional control features.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components are positioned in one replaceable unit (an imaging unit). The image forming device's toner supply, which is consumed relatively quickly in comparison with the components housed in the imaging unit, is provided in a reservoir in a separate replaceable unit in the form of a toner cartridge that feeds toner to the imaging unit. In this configuration, the number of components housed in the toner cartridge is reduced in comparison with traditional toner cartridges.

It is important that the toner cartridge is precisely aligned within the image forming device. If the toner cartridge is misaligned, a toner outlet port on the toner cartridge may not seal against a port that receives toner from the toner cartridge potentially causing toner leakage which may result in mechanical and print quality defects. Further, if the toner cartridge is misaligned, a drive gear on the toner cartridge may not achieve proper gear mesh with a corresponding drive gear in the image forming device. The toner cartridge must also be rigidly held in place after it is installed in the image forming device in order to prevent the positional alignment of the toner cartridge from being disturbed during operation. The requirement for tight positional control must be balanced with the need to permit a user to easily load and unload the toner cartridge into and out of the image forming device. Accordingly, it will be appreciated that precise alignment of the toner cartridge and relatively simple insertion and removal of the toner cartridge into and out of the image forming device is desired.

SUMMARY

A toner cartridge for use in an electrophotographic image forming device according to one example embodiment includes a housing having a top, a bottom, a front and a rear positioned between a first side and a second side of the housing. The housing has a reservoir for holding toner. An outlet port is in fluid communication with the reservoir and faces downward on the front of the housing for exiting toner from the toner cartridge. The toner cartridge. The toner delivery system includes a toner delivery system for transferring toner from the reservoir out of the outlet port that includes a main input gear for providing rotational power to the toner delivery system. A top portion of the main input gear is exposed at the first side of the housing for mating with a corresponding drive gear in the image forming device when the toner cartridge is installed in the image forming device. The main input gear includes a rotational axis. A first alignment guide extends outward from the first side of the housing and runs along a front-to-rear dimension of the housing. A second alignment guide extends outward from the second side of the housing and runs along the front-to-rear dimension of the housing. The second alignment guide is parallel to and aligned in a vertical dimension of the housing with the first alignment guide. A third alignment guide and a fourth alignment guide extend outward from the first side of the housing. The third alignment guide is spaced toward the front of the housing from the fourth alignment guide. Each of the third alignment guide and the fourth alignment guide includes a respective bottom surface that is unobstructed to permit the respective bottom surface to sit on top of a corresponding guide surface in the image forming device to control a vertical position of the toner cartridge when the toner cartridge is installed in the image forming device. The bottom surface of the third alignment guide is aligned with the bottom surface of the fourth alignment guide in the vertical dimension of the housing. The bottom surfaces of the third and fourth alignment guides are positioned higher than the first and second alignment guides. The bottom surfaces of the third and fourth alignment guides are positioned higher than the rotational axis of the main input gear and are positioned closer to the rear of the housing than the rotational axis of the main input gear is to the rear of the housing.

A toner cartridge for use in an electrophotographic image forming device according to another example embodiment includes a housing having a top, a bottom, a front and a rear positioned between a first side and a second side of the housing. The housing has a reservoir for holding toner. An outlet port is in fluid communication with the reservoir and faces downward on the front of the housing for exiting toner from the toner cartridge. The toner cartridge includes a toner delivery system for transferring toner from the reservoir out of the outlet port. The toner delivery system includes a main input gear for providing rotational power to the toner delivery system. A top portion of the main input gear is exposed at the first side of the housing for mating with a corresponding drive gear in the image forming device when the toner cartridge is installed in the image forming device. The main input gear includes a rotational axis. A first alignment guide extends outward from the second side of the housing and runs along a front-to-rear dimension of the housing. The first alignment guide includes a bottom surface that is unobstructed to permit the bottom surface of the first alignment guide to sit on top of a corresponding first guide surface in the image forming device to control a vertical position of the toner cartridge when the toner cartridge is installed in the image forming device. A second alignment guide and a third alignment guide extend outward from the first side of the housing. The second alignment guide is spaced toward the front of the housing from the third alignment guide. Each of the second alignment guide and the third alignment guide includes a respective bottom surface that is unobstructed to permit the respective bottom surfaces of the second and third alignment guides to sit on top of a corresponding second guide surface in the image forming device to control the vertical position of the toner cartridge when the toner cartridge is installed in the image forming device. The bottom surface of the second alignment guide is aligned with the bottom surface of the third alignment guide in a vertical dimension of the housing. The bottom surfaces of the second and third alignment guides are positioned higher than the first alignment guide. The bottom surfaces of the second and third alignment guides are positioned higher than the rotational axis of the main input gear and are positioned closer to the rear of the housing than the rotational axis of the main input gear is to the rear of the housing. A fourth alignment guide extends outward from the first side of the housing. The fourth alignment guide includes a front surface and a top surface that are unobstructed to permit the front surface of the fourth alignment guide to provide a forward stop and the top surface of the fourth alignment guide to provide an upward rotational stop when the toner cartridge is installed in the image forming device. The fourth alignment guide is positioned lower than the second and third alignment guides. The fourth alignment guide is spaced toward the rear of the housing from the second alignment guide.

A toner cartridge for use in an electrophotographic image forming device according to another example embodiment includes a housing having a top, a bottom, a front and a rear positioned between a first side and a second side of the housing. The housing has a reservoir for holding toner. An outlet port is in fluid communication with the reservoir and faces downward on the front of the housing for exiting toner from the toner cartridge. The toner cartridge includes a toner delivery system for transferring toner from the reservoir out of the outlet port. The toner deliver system includes a main input gear for providing rotational power to the toner delivery system. A top portion of the main input gear is exposed at the first side of the housing for mating with a corresponding drive gear in the image forming device when the toner cartridge is installed in the image forming device. The main input gear includes a rotational axis. An engagement member is positioned on the first side of the housing. The engagement member includes an angled front surface that faces upward and toward the front of the housing and an angled rear surface that faces upward and toward the rear of the housing. The angled front surface and the angled rear surface are unobstructed from the top to receive a hold down force when the toner cartridge is installed in the image forming device. The angled front surface and the angled rear surface are positioned higher than the rotational axis of the main input gear and are positioned closer to the rear of the housing than the rotational axis of the main input gear is to the rear of the housing. A first alignment guide and a second alignment guide extend outward from the first side of the housing. The first alignment guide is spaced toward the front of the housing from the second alignment guide. Each of the first alignment guide and the second alignment guide includes a respective bottom surface that is unobstructed to permit the respective bottom surface to sit on top of a corresponding guide surface in the image forming device to control a vertical position of the toner cartridge when the toner cartridge is installed in the image forming device. The bottom surface of the first alignment guide is aligned with the bottom surface of the second alignment guide in a vertical dimension of the housing. The bottom surfaces of the first and second alignment guides are positioned higher than the rotational axis of the main input gear and are positioned closer to the rear of the housing than the rotational axis of the main input gear is to the rear of the housing. The bottom surfaces of the first and second alignment guides are positioned lower than the angled front surface and the angled rear surface of the engagement member. The second alignment guide is spaced toward the rear of the housing from the engagement member.

A toner cartridge for use in an electrophotographic image forming device according to another example embodiment includes a housing having a top, a bottom, a front and a rear positioned between a first side and a second side of the housing. The housing has a reservoir for holding toner. An outlet port is in fluid communication with the reservoir and faces downward on the front of the housing for exiting toner from the toner cartridge. The toner cartridge includes a toner delivery system for transferring toner from the reservoir out of the outlet port. The toner delivery system includes a main input gear for providing rotational power to the toner delivery system. A top portion of the main input gear is exposed at the first side of the housing for mating with a corresponding drive gear in the image forming device when the toner cartridge is installed in the image forming device. The main input gear includes a rotational axis. An engagement member is positioned on the first side of the housing. The engagement member includes an angled front surface that faces upward and toward the front of the housing and an angled rear surface that faces upward and toward the rear of the housing. The angled front surface and the angled rear surface are unobstructed from the top to receive a hold down force when the toner cartridge is installed in the image forming device. A peak of the engagement member positioned between the angled front surface and the angled rear surface is positioned higher than a topmost portion of the main input gear and is positioned closer to the rear of the housing than the rotational axis of the main input gear is to the rear of the housing. A first alignment guide extends outward from the first side of the housing. The first alignment guide includes a bottom surface that is unobstructed to permit the bottom surface of the first alignment guide to sit on top of a corresponding guide surface in the image forming device to control a vertical position of the toner cartridge when the toner cartridge is installed in the image forming device. The bottom surface of the first alignment guide is positioned higher than the rotational axis of the main input gear and is positioned closer to the rear of the housing than the rotational axis of the main input gear is to the rear of the housing. The bottom surface of the first alignment guide is positioned lower than the peak of the engagement member. A second alignment guide extends outward from the first side of the housing. The second alignment guide includes a front surface and a top surface that are unobstructed to permit the front surface of the second alignment guide to provide a forward stop and the top surface of the second alignment guide to provide an upward rotational stop when the toner cartridge is installed in the image forming device. The second alignment guide is positioned lower than the first alignment guide. The second alignment guide is spaced toward the rear of the housing from the engagement member.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
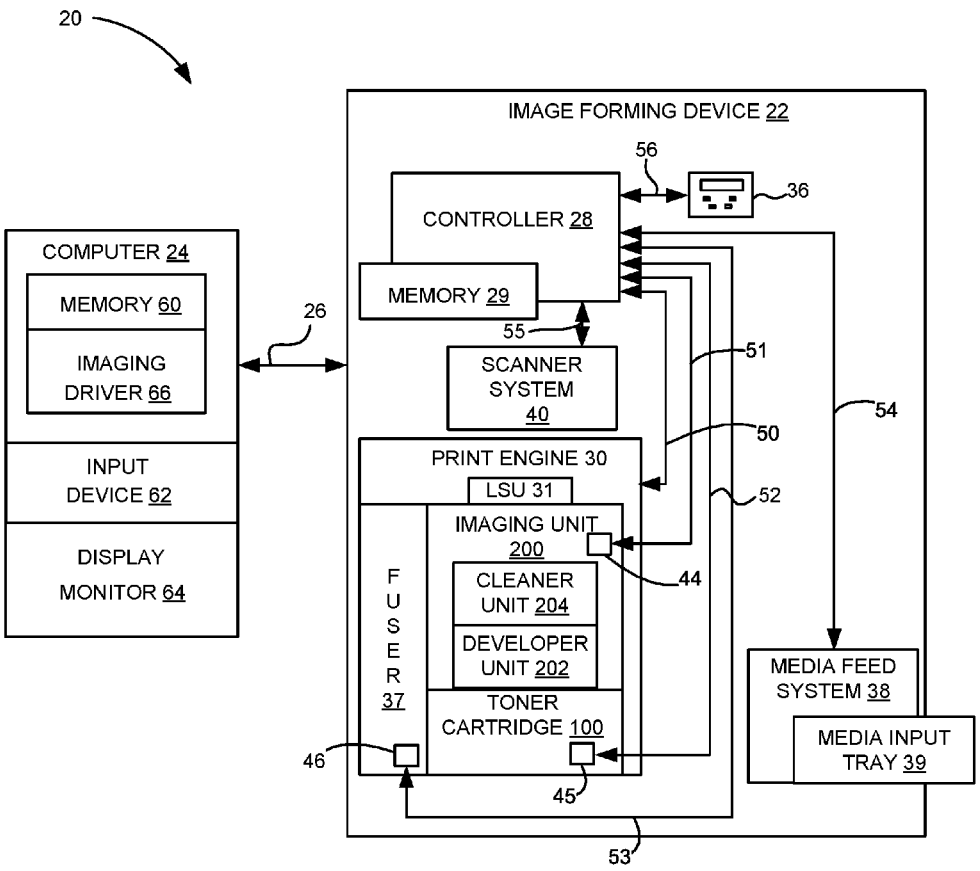
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with a fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 202 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 202 includes a magnetic roll that attracts the magnetic carrier beads having toner thereon to the magnetic roll through the use of magnetic fields. Imaging unit 200 also includes a cleaner unit 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner sump in developer unit 202.

The electrophotographic printing process is well known in the art and, therefore, is described briefly herein. During a printing operation, laser scan unit 31 creates a latent image on the photoconductive drum in cleaner unit 204. Toner is transferred from the toner sump in developer unit 202 to the latent image on the photoconductive drum by the developer roll (in the case of a single component development system) or by the magnetic roll (in the case of a dual component development system) to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
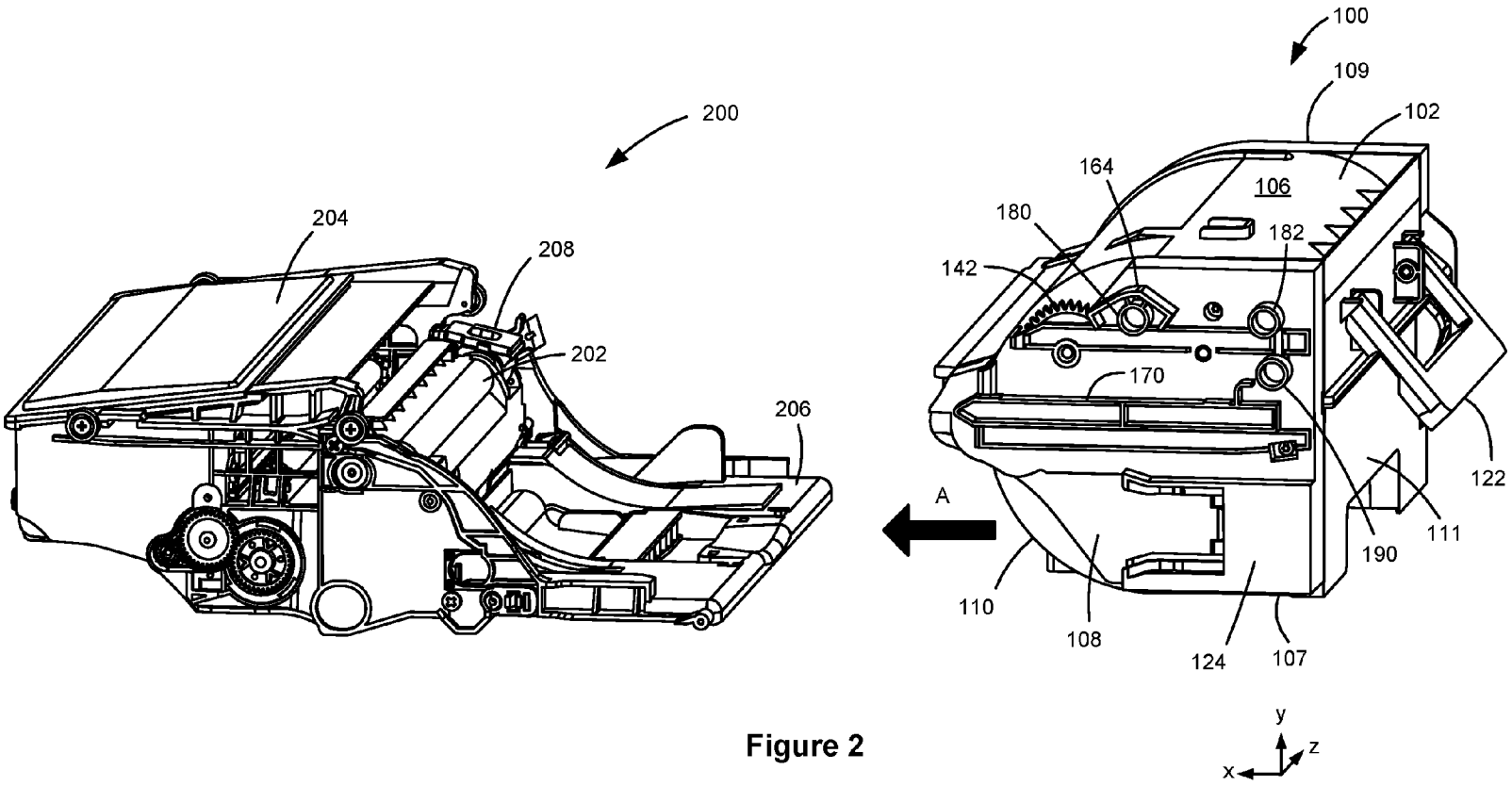
FIG. 2 is a perspective view of a toner cartridge and an imaging unit according to one example embodiment.

Referring now to FIG. 2, toner cartridge 100 and imaging unit 200 are shown according to one example embodiment. Imaging unit 200 includes a developer unit 202 and a cleaner unit 204 mounted on a common frame 206. Developer unit 202 includes a toner inlet port 208 positioned to receive toner from toner cartridge 100. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow A shown in FIG. 2, which also indicates the direction of insertion of imaging unit 200 and toner cartridge 100 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

With reference to FIGS. 2-5, toner cartridge 100 includes a housing 102 having an enclosed reservoir 104 (FIG. 5) for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. An outlet port 118 in fluid communication with reservoir 104 is positioned facing downward on front 110 of housing 102 near side 109 for exiting toner from toner cartridge 100. A handle 122 may be provided on top 106 or rear 111 of housing 102 to assist with insertion and removal of toner cartridge 100 into and out of image forming device 22.

Figure 5:
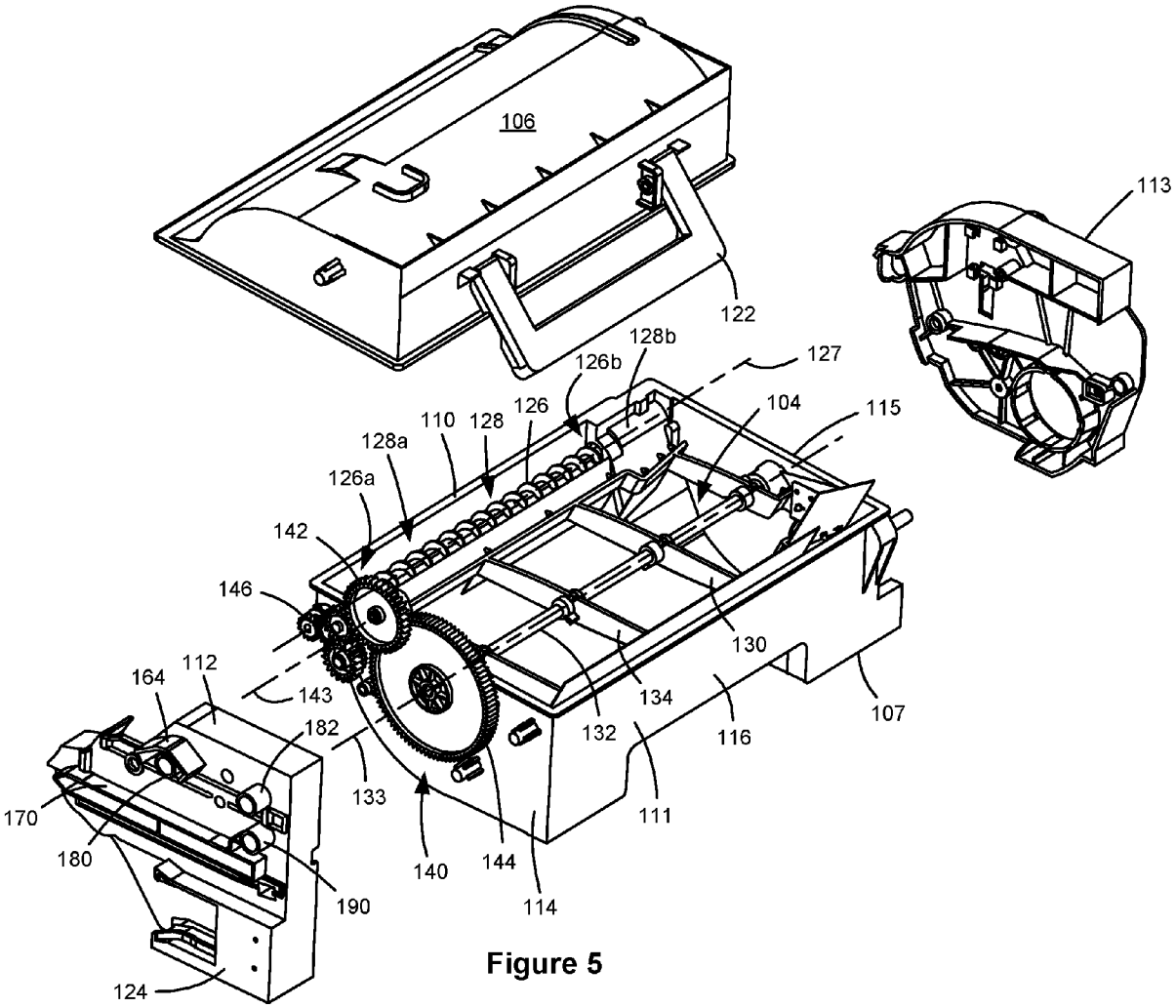
FIG. 5 is an exploded view of the toner cartridge shown in FIGS. 2-4 showing a reservoir for holding toner therein.

With reference to FIG. 5, in the example embodiment illustrated, an auger 126 having first and second ends **126*a*, 126*b* and a spiral screw flight is positioned in a channel 128 that runs along the front 110 of housing 102 from side 108 to side 109. Channel 128 may be integrally molded as part of the front 110 of main body 116 or formed as a separate component that is attached to the front 110 of main body 116. Channel 128 is oriented generally horizontal when toner cartridge 100 is installed in image forming device 22. Auger 126 includes a rotational axis 127. Rotation of auger 126 delivers toner in channel 128 to outlet port 118, which is positioned at the bottom of channel 128 so that gravity assists in exiting toner through outlet port 118. Channel 128 includes an open portion 128*a* and may include an enclosed portion 128*b*. Open portion 128*a* is open to toner reservoir 104 and extends from side 108 toward second end 126*b* of auger 126. Enclosed portion 128*b* of channel 128 extends from side 109 and encloses second end 126*b* of auger 126. In this embodiment, outlet port 118 is positioned at the bottom of enclosed portion 128*b* of channel 128**.

A toner agitator assembly 130 is rotatably positioned within toner reservoir 104. Toner agitator assembly 130 includes a rotatable drive shaft 132 and one or more toner agitators 134 that extend from drive shaft 132. Drive shaft 132 includes a rotational axis 133. In the example embodiment illustrated, rotational axis 133 of drive shaft 132 is parallel to rotational axis 127 of auger 126. Toner agitators 134 rotate with drive shaft 132 around rotational axis 133 when drive shaft 132 rotates. As drive shaft 132 rotates, toner agitators 134 agitate and mix the toner stored in toner reservoir 104 and, in the embodiment illustrated, move toner toward channel 128 where auger 126 moves the toner to outlet port 118. In the example embodiment illustrated, first and second ends of drive shaft 132 extend through aligned openings in side walls 114, 115, respectively. However, drive shaft 132 may take other positions and orientations as desired. Bushings may be provided on an inner side of each side wall 114, 115 where drive shaft 132 passes through side walls 114, 115.

Figure 3:
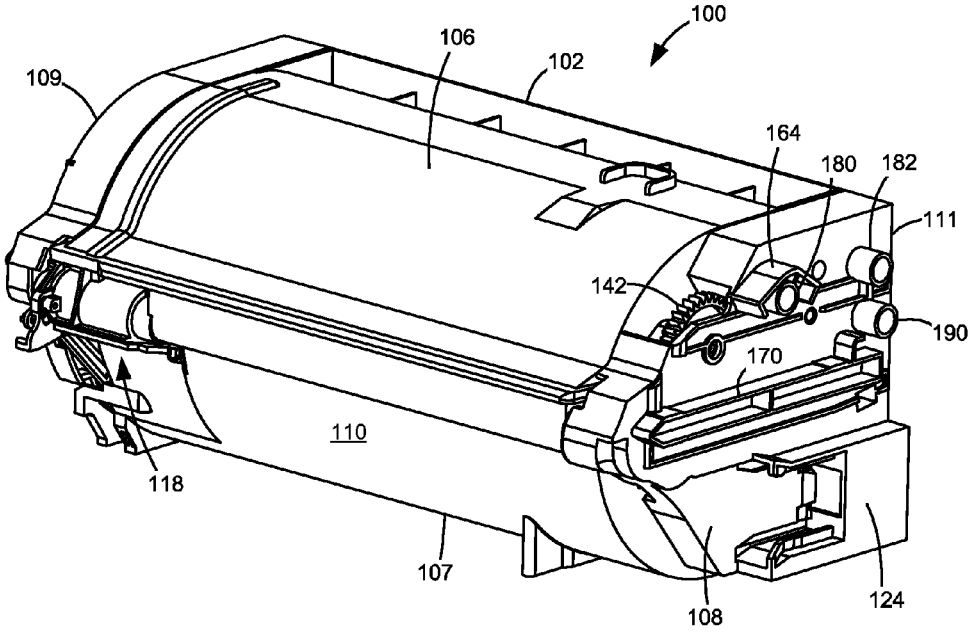
FIG. 3 is a front perspective view of the toner cartridge shown in FIG. 2.
Figure 4:
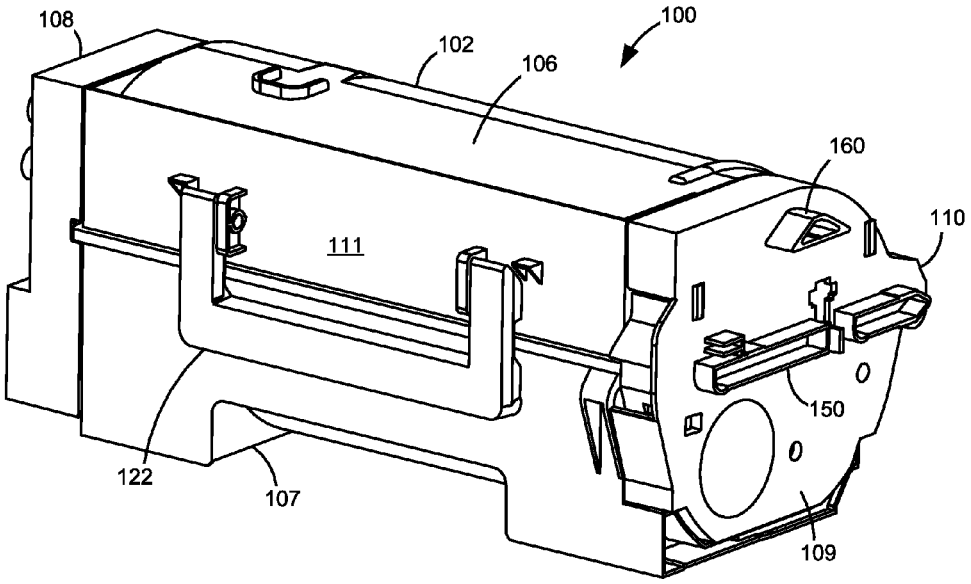
FIG. 4 is a rear perspective view of the toner cartridge shown in FIGS. 2 and 3.

A drive train 140 is operatively connected to drive shaft 132 and may be positioned within a space formed between end cap 112 and side wall 114. Drive train 140 includes a main input gear 142 that engages with a drive gear in image forming device 22 that provides rotational motion from an electric motor in image forming device 22 to main input gear 142. As shown in FIG. 3, in one embodiment, a portion of main input gear 142 is exposed at the front 110 of housing 102 near the top 106 of housing 102 where main input gear 142 engages the drive gear in image forming device 22. Main input gear 142 includes a rotational axis 143. With reference back to FIG. 5, in the embodiment illustrated, drive train 140 also includes a drive gear 144 on one end of drive shaft 132 that is connected to main input gear 142 either directly or via one or more intermediate gears to rotate drive shaft 132. In the embodiment illustrated, drive train 140 also includes a drive gear 146 on first end 126*a* of auger 126 that is connected to main input gear 142 either directly or via one or more intermediate gears to rotate auger 126.

With reference back to FIG. 2, when toner cartridge 100 is installed in image forming device 22, various interface features of toner cartridge 100 must align with corresponding interface features on imaging unit 200 and image forming device 22. In the final position of toner cartridge 100 in image forming device 22, toner cartridge 100 is positioned above frame 206 of imaging unit 200 with outlet port 118 aligned and mated with inlet port 208 of developer unit 202. As discussed above, outlet port 118 and inlet port 208 must be precisely aligned in order to prevent toner leakage between toner cartridge 100 and developer unit 202. Further, main input gear 142 of toner cartridge 100 must align and mate with the corresponding drive gear in image forming device 22 that provides rotational motion to main input gear 142. If main input gear 142 is misaligned, proper gear mesh may not be achieved. In addition, electrical contacts for processing circuitry 45 of toner cartridge 100 positioned within a connector 124 on side 108 of toner cartridge 100 must align and mate with corresponding electrical contacts in image forming device 22 in order to permit communication between toner cartridge 100 and image forming device 22. The positions of these various interface points must be tightly controlled in order to ensure proper operation of toner cartridge 100.

Figure 6:
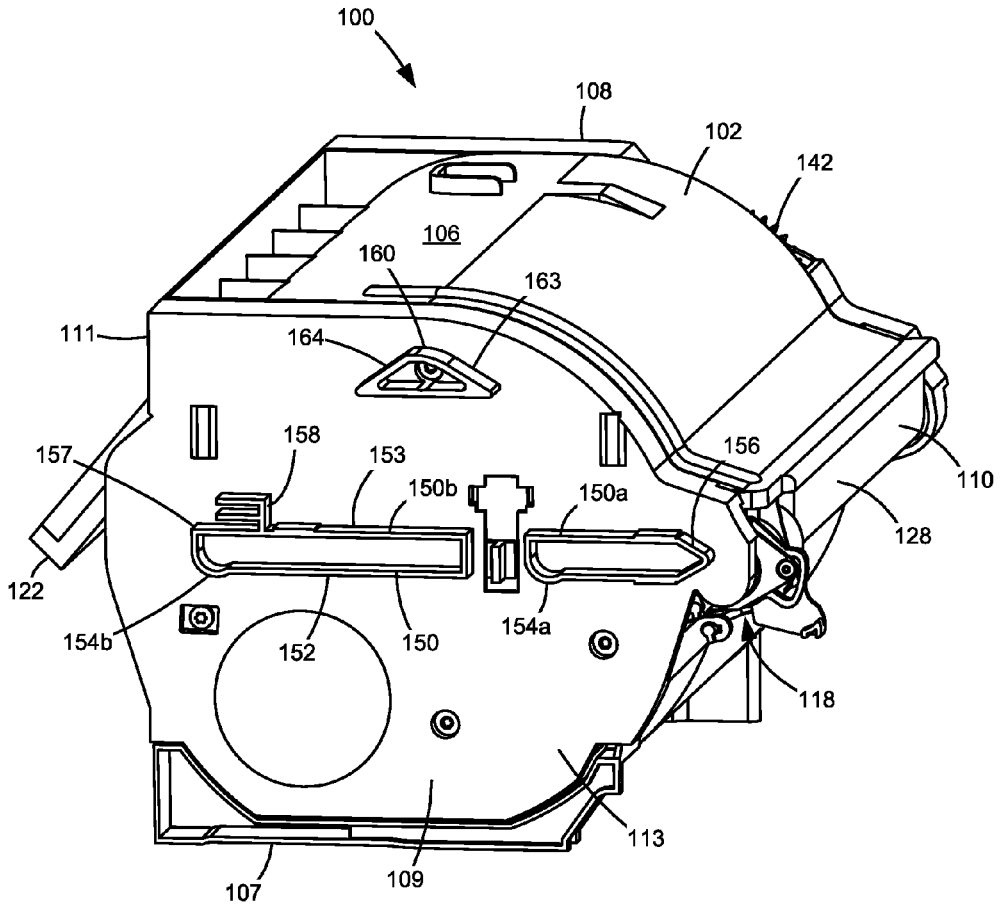
FIG. 6 is a first side perspective view of the toner cartridge shown in FIGS. 2-5.

With reference to FIG. 6, in the example embodiment illustrated, side 109 includes an alignment guide 150 that extends outward from side 109. As discussed in greater detail below, alignment guide 150 travels in a corresponding guide slot in image forming device 22 that guides the insertion of toner cartridge 100 into image forming device 22. In the example embodiment illustrated, alignment guide 150 is positioned on the outer side of end cap 113. Alignment guide 150 runs along a front-to-rear dimension (x-dimension shown in FIG. 2) of housing 102 as shown in FIG. 6. In the example embodiment illustrated, alignment guide 150 includes a pair of segments 150*a*, 150*b*. Each segment 150*a*, 150*b* extends in an elongated manner along the front-to-rear dimension of housing 102. In the example embodiment illustrated, alignment guide 150 is aligned in a vertical dimension (y-dimension shown in FIG. 2) of housing 102 with channel 128 as shown in FIG. 6. In this embodiment, alignment guide 150 is positioned lower than rotational axis 143 of main input gear 142. A bottom surface 152 of alignment guide 150 is unobstructed to permit bottom surface 152 to sit on top of a corresponding guide surface in image forming device 22 in order to control the vertical position of toner cartridge 100 in image forming device 22. In some embodiments, bottom surface 152 of alignment guide 150 includes a pair of rounded projections 154*a*, 154*b* that define contact points to control the vertical position of toner cartridge 100 in image forming device 22. For example, in the embodiment illustrated, each segment 150*a*, 150*b* of alignment guide 150 includes a respective rounded projection 154*a*, 154*b* at a rear portion thereof. In some embodiments, alignment guide 150 includes a tapered front tip 156 that helps facilitate entry of alignment guide 150 into the corresponding guide slot in image forming device 22. In the example embodiment illustrated, alignment guide 150 includes a forward stop 158 that extends vertically upward from a top surface 153 of alignment guide 150 near a rear end 157 of alignment guide 150. When toner cartridge 100 is installed in image forming device 22, forward stop 158 contacts a corresponding guide surface in image forming device 22 in order to control the horizontal position of toner cartridge 100 in image forming device 22 along the front-to-rear-dimension of housing 102.

In the example embodiment illustrated, side 109 also includes an engagement member 160 that extends outward from side 109 near the top 106 of housing 102. As discussed in greater detail below, engagement member 160 receives a hold down force from a corresponding biasing member in image forming device 22 to retain toner cartridge 100 in its final position in image forming device 22. In the example embodiment illustrated, engagement member 160 is positioned on the outer side of end cap 113. Engagement member 160 includes an angled front surface 162 that faces upward and forward and an angled rear surface 163 that faces upward and rearward.

Figure 7:
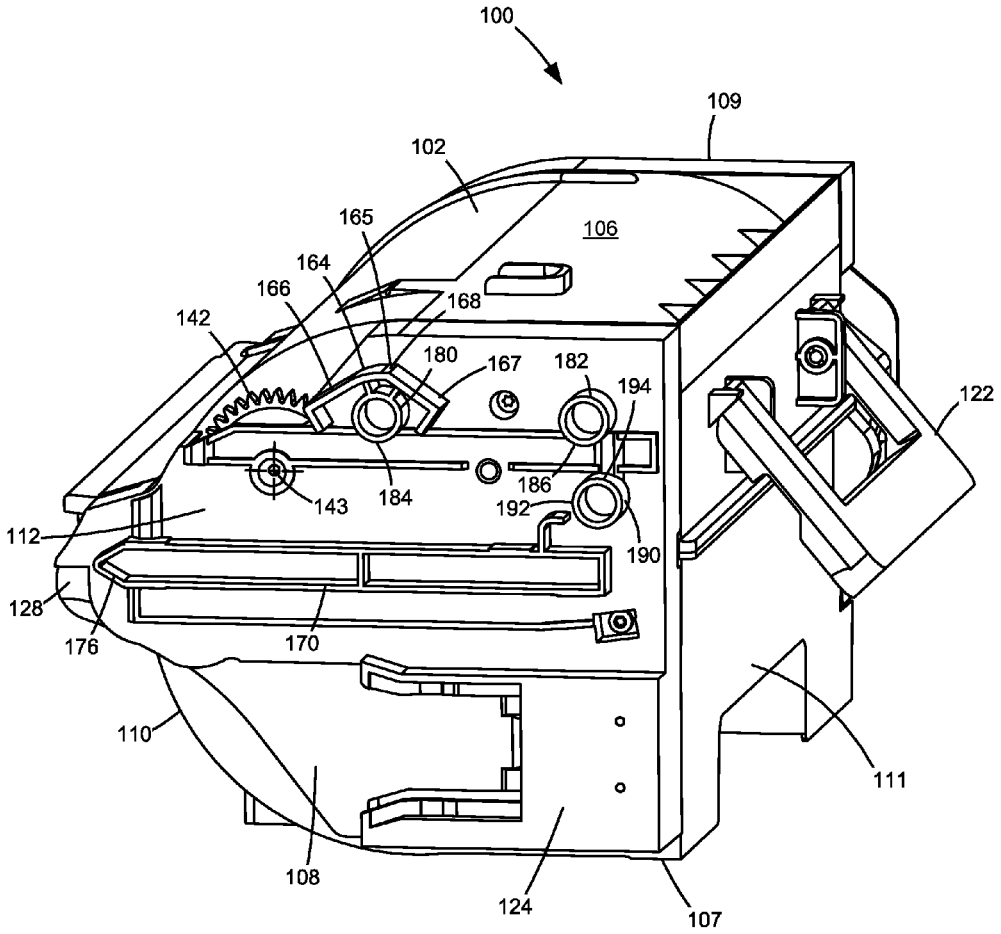
FIG. 7 is a second side perspective view of the toner cartridge shown in FIGS. 2-6.

With reference to FIG. 7, in the example embodiment illustrated, side 108 includes an alignment guide 170 that extends outward from side 108. As discussed in greater detail below, alignment guide 170 travels in a corresponding guide slot in image forming device 22 that guides the insertion of toner cartridge 100 into image forming device 22. In the example embodiment illustrated, alignment guide 170 is positioned on the outer side of end cap 112. Alignment guide 170 runs along the front-to-rear dimension of housing 102 as shown in FIG. 7. In the example embodiment illustrated, alignment guide 170 includes a single segment that extends in an elongated manner along the front-to-rear dimension of housing 102. Alignment guide 170 is parallel to and aligned in the vertical dimension of housing 102 with alignment guide 150 on side 109. In the example embodiment illustrated, alignment guide 170 is aligned in the vertical dimension of housing 102 with channel 128. In this embodiment, alignment guide 170 is positioned lower than rotational axis 143 of main input gear 142. In some embodiments, alignment guide 170 includes a tapered front tip 176 that helps facilitate entry of alignment guide 170 into the corresponding guide slot in image forming device 22. In the example embodiment illustrated, alignment guide 170 provides coarse alignment of toner cartridge 100 during insertion of toner cartridge 100 into image forming device 22 as discussed in greater detail below.

In the example embodiment illustrated, side 108 also includes an engagement member 164 that extends outward from side 108 near the top 106 of housing 102. As discussed in greater detail below, engagement member 164 receives a hold down force from a corresponding biasing member in image forming device 22 to retain toner cartridge 100 in its final position in image forming device 22. In the example embodiment illustrated, engagement member 164 is positioned on the outer side of end cap 112. Like engagement member 160 discussed above, engagement member 164 includes an angled front surface 166 that faces upward and forward and an angled rear surface 167 that faces upward and rearward. Front surfaces 162, 166 and rear surfaces 163, 167 of engagement members 160, 164 are positioned higher than and spaced rearward from rotational axis 143 of main input gear 142. Engagement member 164 also includes a horizontal surface 168 at a peak 165 of engagement member 164 positioned between angled front surface 166 and angled rear surface 167. Horizontal surface 168 is positioned higher than a topmost portion of main input gear 142.

Side 108 also includes a pair of alignment guides 180, 182 that extend outward from side 108. In the example embodiment illustrated, alignment guides 180, 182 are positioned on the outer side of end cap 112. Each alignment guide 180, 182 includes a bottom surface 184, 186 that is unobstructed to permit bottom surfaces 184, 186 of alignment guides 180, 182 to sit on top of a corresponding guide surface in image forming device 22 in order to control the vertical position of toner cartridge 100 in image forming device 22. Bottom surfaces 184, 186 of alignment guides 180, 182 are aligned with each other in the vertical dimension of housing 102. Alignment guide 180 is positioned closer to front 110 of housing 102 than alignment guide 182 is to front 110 of housing 102. In some embodiments, the bottom surface 184, 186 of each alignment guide 180, 182 includes a rounded contact point to control the vertical position of toner cartridge 100 in image forming device 22. Bottom surfaces 184, 186 of alignment guides 180, 182 are each positioned higher than and spaced rearward from rotational axis 143 of main input gear 142. In the example embodiment illustrated, bottom surfaces 184, 186 of alignment guides 180, 182 are each positioned lower than angled front and rear surfaces 166, 167 and horizontal surface 168 of engagement member 164. In this embodiment, alignment guide 180 is aligned with engagement member 164 along the front-to-rear dimension of housing 102 and alignment guide 182 is spaced rearward from engagement member 164. In the example embodiment illustrated, alignment guides 180, 182 are positioned higher than alignment guides 150 and 170.

In the example embodiment illustrated, side 108 also includes an alignment guide 190 that extends outward from side 108. In the example embodiment illustrated, alignment guide 190 is positioned on the outer side of end cap 112. Alignment guide 190 includes a front surface 192 and a top surface 194 that are unobstructed to permit front surface 192 and top surface 194 to contact a corresponding guide surface in image forming device 22. As discussed in greater detail below, front surface 192 of alignment guide 190 serves as a forward stop to control the horizontal position of toner cartridge 100 in image forming device 22 along the front-to-rear-dimension of housing 102. Top surface 194 of alignment guide 190 serves as a rotational stop to prevent rotation of housing 102 within image forming device 22 about an axis parallel to rotational axis 143 of main input gear 142. Alignment guide 190 is positioned lower than alignment guides 180, 182. In the example embodiment illustrated, alignment guide 190 is spaced rearward from alignment guide 180 and is positioned slightly rearward from alignment guide 182. Alignment guide 190 is also spaced rearward from rotational axis 143 of main input gear 142. In the example embodiment illustrated, alignment guide 190 is positioned lower than and spaced rearward from angled front and rear surfaces 166, 167 and horizontal surface 168 of engagement member 164. In the example embodiment illustrated, alignment guide 190 is positioned higher than alignment guides 150 and 170.

Figure 8A:
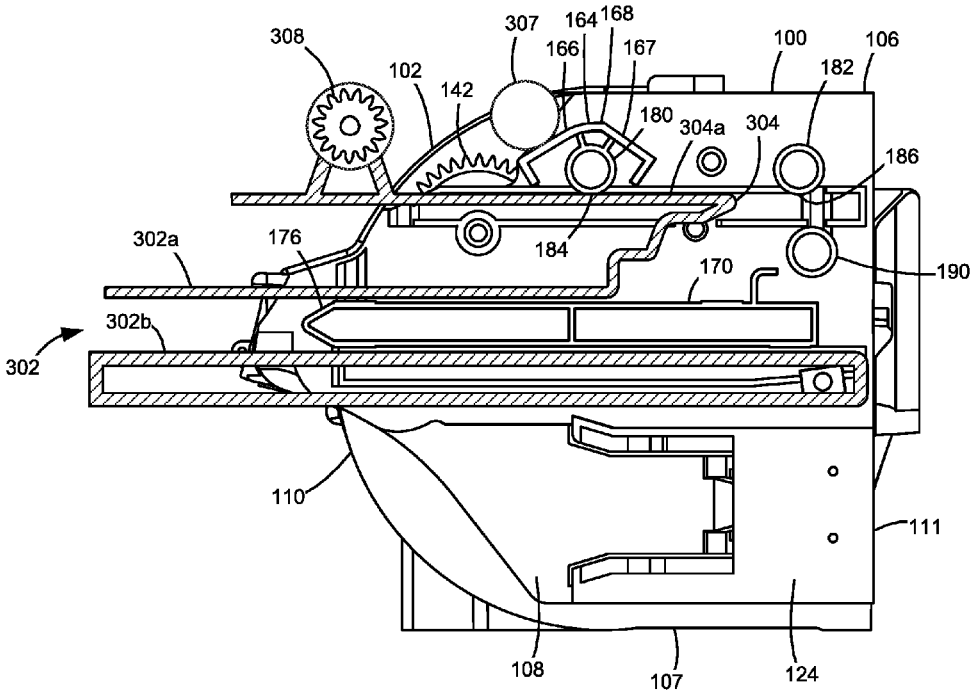
FIGS. 8A and 8B are side elevation views of a first side and a second side, respectively, of the toner cartridge as the toner cartridge is inserted into an image forming device prior to reaching the final position of the toner cartridge in the image forming device according to one example embodiment.
Figure 8B:
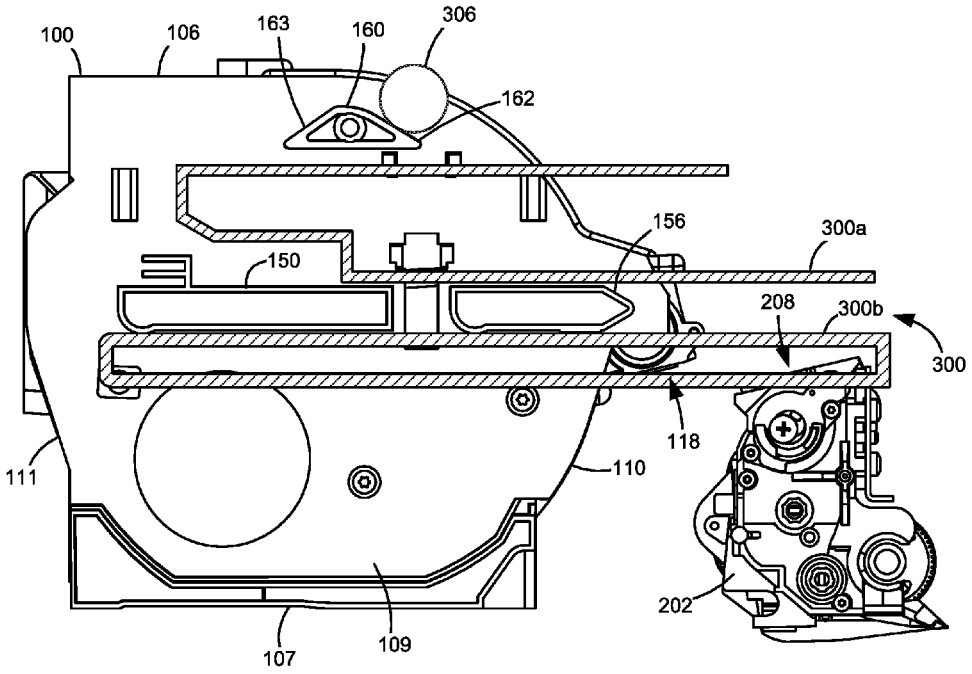

FIGS. 8A and 8B show toner cartridge 100 as toner cartridge 100 is inserted into image forming device 22 prior to reaching the final position of toner cartridge 100 in image forming device 22. As toner cartridge 100 is inserted into image forming device 22, alignment guides 150, 170 enter corresponding guide slots 300, 302 in image forming device 22. Guide slot 300 is defined by a top guide 300*a* and a bottom guide 300*b*. Similarly, guide slot 302 is defined by a top guide 302*a* and a bottom guide 302*b*. As toner cartridge 100 is first inserted into image forming device 22, alignment guides 150, 170 enter corresponding guide slots 300, 302 with front tips 156, 176 leading. The initial engagement of alignment guides 150, 170 with guide slots 300, 302 provides coarse alignment of toner cartridge 100 allowing the user a relatively broad range of permissible angles of insertion. As toner cartridge 100 advances further into image forming device 22, alignment guides 150, 170 advance further into guide slots 300, 302 and the engagement between alignment guides 150, 170 and guide slots 300, 302 limits the angle of insertion due to the elongated nature of alignment guides 150, 170 in the front-to-rear dimension of housing 102. As toner cartridge 100 continues to advance, bottom surfaces 184, 186 of alignment guides 180, 182 contact a top surface 304*a* of a guide 304 in image forming device 22. As toner cartridge 100 is inserted further into image forming device 22, a pair of rollers 306, 307 in image forming device 22 that are spring-biased into the insertion path of toner cartridge 100 contact angled front surfaces 162, 166 of engagement members 160, 164 as shown in FIGS. 8A and 8B. The force applied to toner cartridge 100 by rollers 306, 307 controls the entry of toner cartridge 100 and prevents toner cartridge 100 from advancing into image forming device 22 too quickly.

Figure 9A:
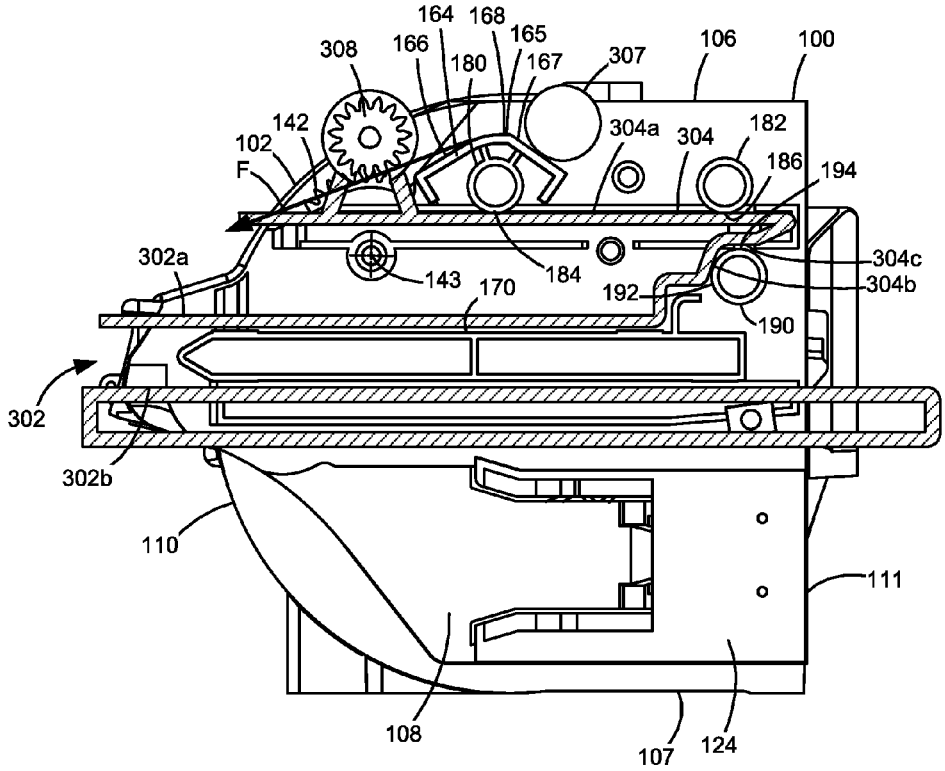
FIGS. 9A and 9B are side elevation views of the first side and the second side, respectively, of the toner cartridge in the final position of the toner cartridge in the image forming device according to one example embodiment.
Figure 9B:
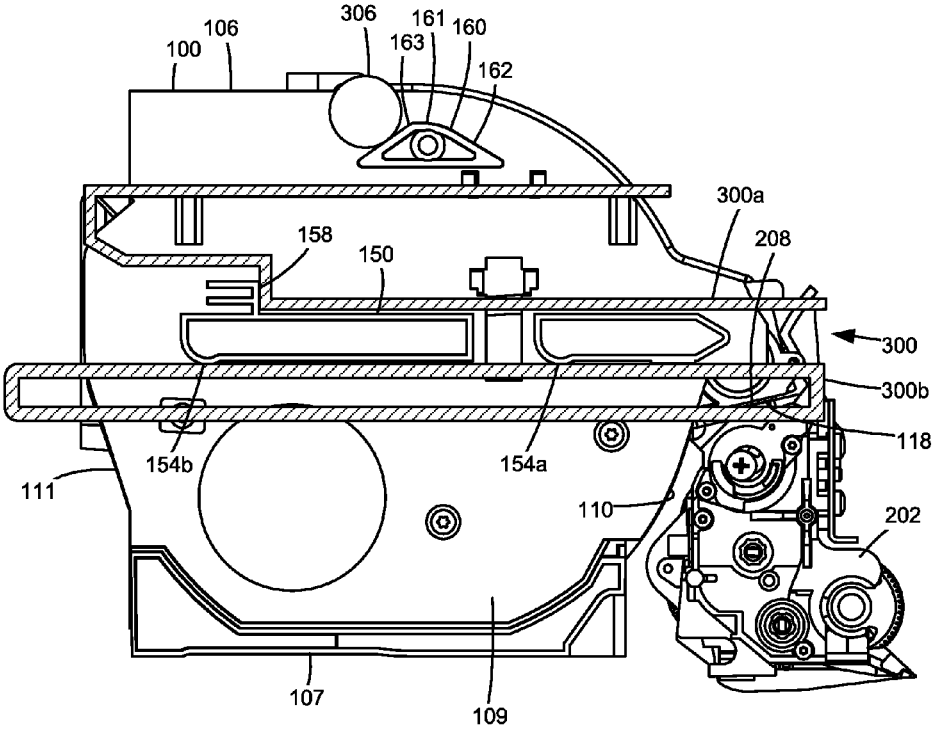

FIGS. 9A and 9B show toner cartridge 100 in its final position in image forming device 22. As shown in FIG. 9A, in the final position of toner cartridge 100, a drive gear 308 in image forming device 22 is operatively mated with main input gear 142 of toner cartridge 100. Drive gear 308 is operatively connected to an electric motor in image forming device that provides rotational motion to drive gear 308. Drive gear 308, in turn, provides rotational motion to main input gear 142 of toner cartridge 100, which rotates auger 126 and toner agitator assembly 130. Drive gear 308 and guide 304 are positioned on a common frame in image forming device 22. In the example embodiment illustrated, a top portion of main input gear 142 is exposed from housing 102 and mates with drive gear 308 of image forming device 22. In this embodiment, the direction of the load on main input gear 142 from the rotation of drive gear 308 is forward, toward the front 110 of housing 102 (as illustrated by the arrow F shown in FIG. 9A). The forward force on main input gear 142 aids in retaining toner cartridge 100 in its final position in image forming device 22. If instead the direction of the load on main input gear 142 was rearward, the force on main input gear 142 would tend to push toner cartridge 100 away from imaging unit 200.

As shown in FIG. 9B, in the final position of toner cartridge 100, outlet port 118 of toner cartridge 100 is mated with inlet port 208 of developer unit 202 to permit the delivery of toner from toner cartridge 100 to developer unit 202.

With reference to FIGS. 9A and 9B, in the final position of toner cartridge 100 in image forming device 22, the vertical position of toner cartridge 100 is controlled by the contact between bottom surfaces 184, 186 of alignment guides 180, 182 and top surface 304*a* of guide 304 on side 108 of housing 102 and by the contact between rounded projections 154*a*, 154*b* of alignment guide 150 and bottom guide 300*b* of guide slot 300 on side 109 of housing 102. In the example embodiment illustrated, alignment guide 170 on side 108 of housing 102 is spaced above bottom guide 302*b* of guide slot 302 in the final position of toner cartridge 100. Locating side 108 of toner cartridge 100 to guide 304 in image forming device 22 helps reduce tolerance stack up between main input gear 142 of toner cartridge 100 and drive gear 308 since drive gear 308 and guide 304 are positioned on a common frame. In this manner, locating side 108 of toner cartridge 100 to guide 304 helps prevent misalignment between main input gear 142 and drive gear 308 in comparison with locating side 108 of toner cartridge 100 to bottom guide to 302*b* of guide slot 302.

As toner cartridge 100 advances to its final position, front surface 192 of alignment guide 190 contacts a rear surface 304*b* of guide 304 on side 108 of housing 102 and forward stop 158 of alignment guide 150 contacts a portion of top guide 300*a* of guide slot 300 on side 109 of housing 102 thereby controlling the horizontal position of toner cartridge 100 along the front-to-rear dimension of housing 102. In the example embodiment illustrated, alignment guide 170 on side 108 of housing 102 is spaced away from top guide 302*a* of guide slot 302 in the final position of toner cartridge 100. As discussed above, locating side 108 of toner cartridge 100 to guide 304 in image forming device 22 helps maintain precise alignment between main input gear 142 of toner cartridge 100 and drive gear 308. In other embodiments, alignment guide 170 may include a forward stop (similar to forward stop 158 of alignment guide 150) that contacts a portion of guide 304 in order to control the horizontal position of toner cartridge 100 along the front-to-rear dimension of housing 102 on side 108 of housing 102.

As toner cartridge 100 advances to its final position, rollers 306, 307 pass over a respective peak 161, 165 of each engagement member 160, 164 including horizontal surface 168 of engagement member 164 until rollers 306, 307 contact angled rear surfaces 163, 167. In the example embodiment illustrated, horizontal surface 168 of engagement member 164 serves as a dwell such that the passing of roller 307 over horizontal surface 168 pauses the motion of a linkage in image forming device 22 that is actuated by the movement of roller 307. The force applied by rollers 306, 307 to rear surfaces 163, 167 of engagement members 160, 164 urges toner cartridge 100 toward its final position in image forming device 22 and helps retain toner cartridge 100 in its final position in image forming device 22. Specifically, in the example embodiment illustrated, the force applied by rollers 306, 307 to engagement members 160, 164 helps maintain contact between bottom surfaces 184, 186 of alignment guides 180, 182 and top surface 304*a* of guide 304 on side 108 of housing 102 and between rounded projections 154*a*, 154*b* of alignment guide 150 and bottom guide 300*b* of guide slot 300 in order to maintain the vertical position of toner cartridge 100 as well as contact between front surface 192 of alignment guide 190 and rear surface 304*b* of guide 304 and between forward stop 158 of alignment guide 150 and a portion of top guide 300*a* of guide slot 300 in order to maintain the horizontal position of toner cartridge 100 along the front-to-rear dimension of housing 102.

Further, in the example embodiment illustrated, top surface 194 of alignment guide 190 serves as a rotational stop to prevent rotation of housing 102 within image forming device 22. Specifically, the forward and downward force on main input gear 142 resulting from the rotation of drive gear 308 may cause toner cartridge 100 to rotate about the contact point between bottom surface 184 of alignment guide 180 and top surface 304*a* of guide 304 causing the rear 111 of housing 102 to lift up. Top surface 194 of alignment guide 190 is positioned in close proximity to a bottom surface 304*c* of guide 304 in the final position of toner cartridge 100 so that if rear 111 of housing 102 begins to rotate upward, top surface 194 of alignment guide 190 will contact bottom surface 304*c* of guide 304 in order to prevent further rotation of toner cartridge 100. In other embodiments, alignment guide 170 may include a rotational stop that contacts a portion of guide 304 in order to prevent rotation of toner cartridge 100.

Figure 10:
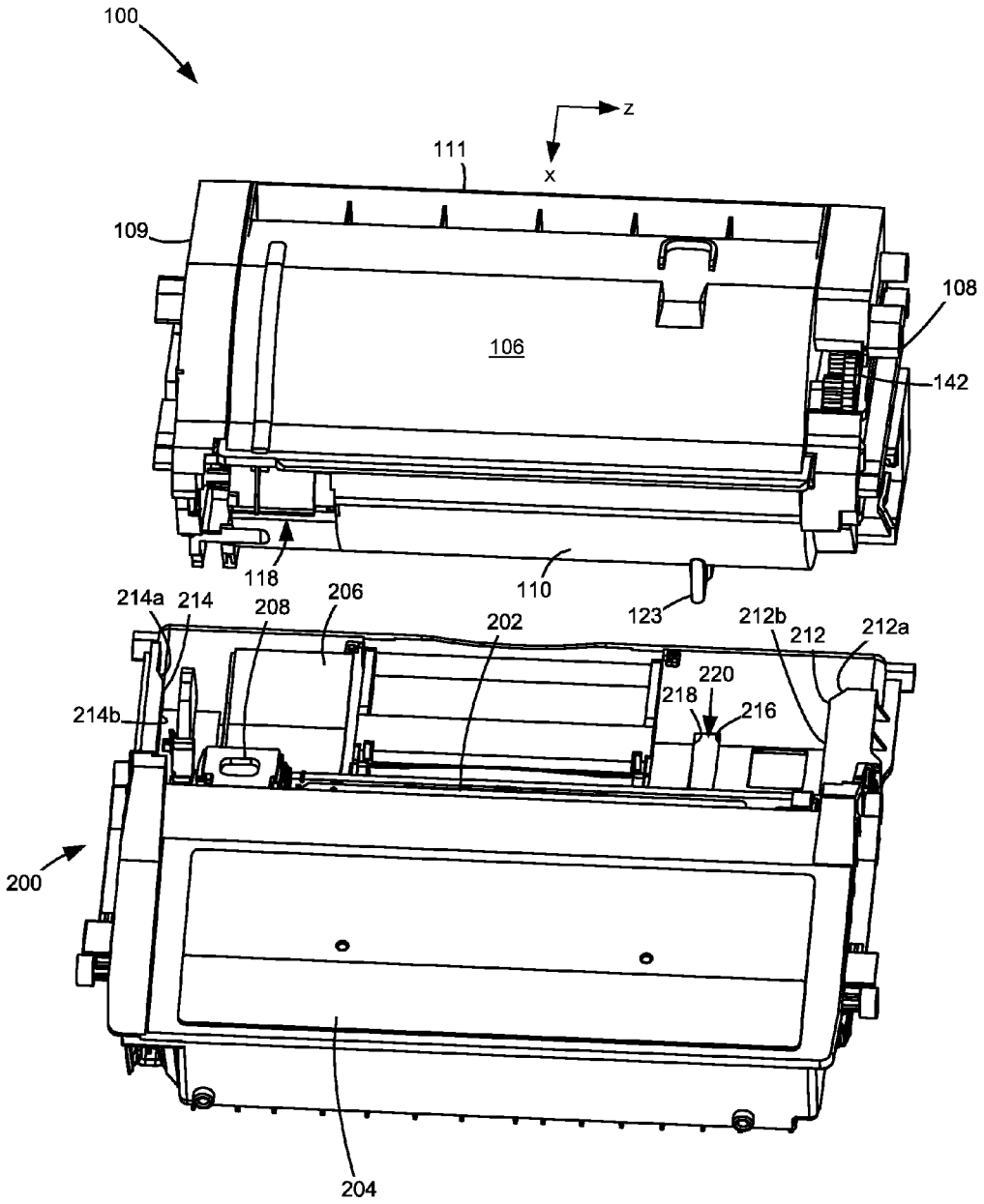
FIG. 10 is a top perspective view of the toner cartridge and the imaging unit according to one example embodiment.

With reference to FIGS. 2 and 10, in the example embodiment illustrated, toner cartridge 100 and imaging unit 200 include both coarse and fine positioning features that control the horizontal position of toner cartridge 100 relative to imaging unit 200 along a side-to-side dimension (z-dimension shown in FIG. 2) of housing 102. In this embodiment, frame 206 of imaging unit 200 includes a pair of vertical walls 212, 214 positioned at opposite sides of imaging unit 200. Each vertical wall 212, 214 may include a beveled front surface 212*a*, 214*a* that is angled along the direction of insertion of toner cartridge 100. Each vertical wall 212, 214 also includes an inner surface 212*b*, 214*b* that is substantially parallel to the direction of insertion of toner cartridge 100. As toner cartridge 100 is inserted into image forming device 22, beveled front surfaces 212*a*, 214*a* guide toner cartridge 100 toward developer unit 202 and limit the travel of toner cartridge 100 in the side-to-side dimension of housing 102. If toner cartridge 100 is misaligned in the side-to-side dimension of housing 102 during insertion, an outer side surface of housing 102 will contact the corresponding front surface 212*a* or 214*a* of vertical walls 212, 214. The angle of the front surface 212*a* or 214*a* will then urge toner cartridge 100 toward its proper alignment in the side-to-side dimension of housing 102 thereby providing coarse positional control as toner cartridge 100 advances toward developer unit 202.

As toner cartridge 100 advances further, housing 102 is restrained between inner surfaces 212*b*, 214*b* of vertical walls 212, 214 further limiting the travel of toner cartridge 100 in the side-to-side dimension of housing 102. In the example embodiment illustrated, these coarse positional control features lead to fine control features in the form of a tightly controlled slot and tab interface. Frame 206 includes a second pair of vertical walls 216, 218 that are spaced closely together forming a slot 220 therebetween. Vertical walls 216, 218 are positioned between vertical walls 212, 214. As toner cartridge 100 advances closer to developer unit 202, a tab 123 from the front 110 of housing 102, near the bottom 107 of housing 102 is tightly received in slot 220. The contact between tab 123 and vertical walls 216, 218 forming slot 220 controls the final horizontal position of toner cartridge 100 in the side-to-side dimension of housing 102.

Figure 11:
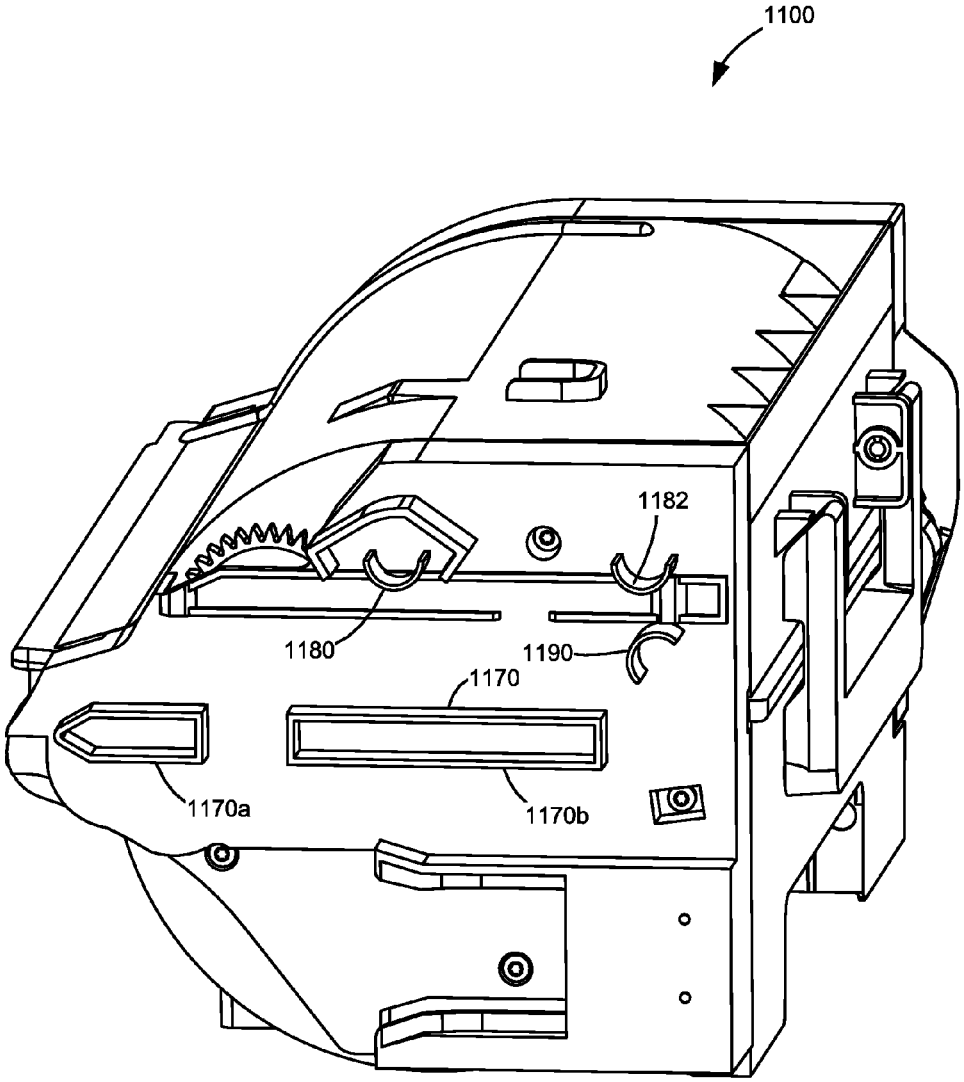
FIG. 11 is a side perspective view of a toner cartridge according to another example embodiment.
Figure 12:
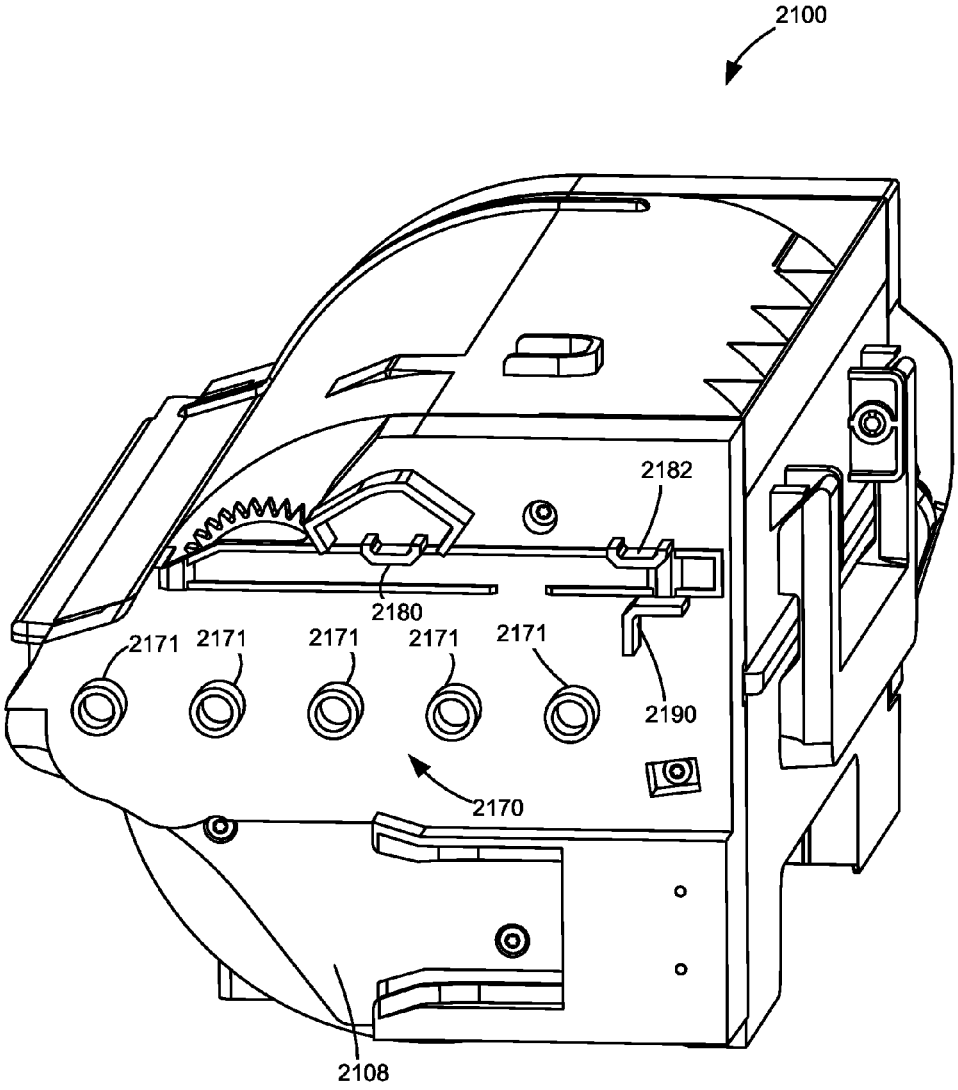
FIG. 12 is a side perspective view of a toner cartridge according to another example embodiment.

While the example embodiment illustrated includes alignment guides 180, 182, 190 in the form of circular projections that extend outward from side 108, it will be appreciated that alignment guides 180, 182, 190 may take many suitable shapes and forms. Alignment guides 180, 182, 190 may include fixed projections on housing 102 as illustrated or rotatable elements, such as rolls, to aid in insertion of toner cartridge 100 into image forming device 22. Further, alignment guides 180, 182, 190 may all take the same form or different forms. Similarly, while the example embodiment illustrated includes alignment guides 150, 170 having a wing-like structure that is elongated in the front-to-rear dimension of housing 102, any suitable shape or form may be utilized as desired. Further, alignment guides 150, 170 may have the same form as each other or different forms. For example, FIG. 11 shows a toner cartridge 1100 according to another example embodiment. In this embodiment, toner cartridge 1100 includes an alignment guide 1170 (similar to alignment guide 170 discussed above) that is split into a pair of segments 1170*a*, 1170*b* (similar to alignment guide 150 discussed above). In this embodiment, toner cartridge 1100 includes alignment guides 1180, 1182 (similar to alignment guides 180, 182 discussed above) each in the form of a semi-circle that is convex to the bottom of toner cartridge 1100 to control the vertical position of toner cartridge 1100 as discussed above. An alignment guide 1190 (similar to alignment guide 190 discussed above) is in the form of a partial circle that is convex to the front and the top of toner cartridge 1100 to permit alignment guide 1190 to control the front-to-rear position of toner cartridge 1100 and serve as a rotational stop as discussed above. FIG. 12 shows a toner cartridge 2100 according to another example embodiment. In this embodiment, toner cartridge 2100 includes an alignment guide 2170 (similar to alignment guide 170 discussed above) that is formed by a series of projections 2171 from a side 2108 that are spaced from each other along a front-to-rear dimension of toner cartridge 2100. In this embodiment, toner cartridge 2100 includes alignment guides 2180, 2182 (similar to alignment guides 180, 182 discussed above) each in the form of a segment that is unobstructed at a bottom of the segment to permit alignment guides 2180, 2182 to control the to vertical position of toner cartridge 2100 as discussed above. An alignment guide 2190 (similar to alignment guide 190 discussed above) is in the form of an L-shaped segment that is unobstructed at a front and a top of the segment to permit alignment guide 2190 to control the front-to-rear position of toner cartridge 2100 and serve as a rotational stop as discussed above. Of course, the various shapes and forms of alignment guides illustrated may be intermixed and/or combined with each other and/or with other suitable shapes.

Although the example embodiment shown in FIG. 2 includes a pair of replaceable units in the form of toner cartridge 100 and imaging unit 200, it will be appreciated that the replaceable unit(s) of image forming device 22 may employ any suitable configuration as desired. For example, in one embodiment, the main toner supply for image forming device 22, developer unit 202, and cleaner unit 204 are housed in one replaceable unit. In another embodiment, the main toner supply for image forming device 22 and developer unit 202 are provided in a first replaceable unit and cleaner unit 204 is provided in a second replaceable unit. Further, although the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge for use in an electrophotographic image forming device, comprising:

a housing having a top, a bottom, a front and a rear positioned between a first side and a second side of the housing, the housing has a reservoir for holding toner;

an outlet port in fluid communication with the reservoir and facing downward on the front of the housing for exiting toner from the toner cartridge;

a toner delivery system for transferring toner from the reservoir out of the outlet port that includes a main input gear for providing rotational power to the toner delivery system, a top portion of the main input gear is exposed at the first side of the housing for mating with a corresponding drive gear in the image forming device when the toner cartridge is installed in the image forming device, the main input gear includes a rotational axis;

a first alignment guide that extends outward from the first side of the housing and runs along a front-to-rear dimension of the housing;

a second alignment guide that extends outward from the second side of the housing and runs along the front-to-rear dimension of the housing, the second alignment guide is parallel to and aligned in a vertical dimension of the housing with the first alignment guide; and a third alignment guide and a fourth alignment guide that extend outward from the first side of the housing, the third alignment guide is spaced toward the front of the housing from the fourth alignment guide, each of the third alignment guide and the fourth alignment guide includes a respective bottom surface that is unobstructed to permit the respective bottom surface to sit on top of a corresponding guide surface in the image forming device to control a vertical position of the toner cartridge when the toner cartridge is installed in the image forming device, the bottom surface of the third alignment guide is aligned with the bottom surface of the fourth alignment guide in the vertical dimension of the housing, the bottom surfaces of the third and fourth alignment guides are positioned higher than the first and second alignment guides, the bottom surfaces of the third and fourth alignment guides are positioned higher than the rotational axis of the main input gear and are positioned closer to the rear of the housing than the rotational axis of the main input gear is to the rear of the housing.

2. The toner cartridge of claim 1, further comprising an engagement member on the first side of the housing, the engagement member includes an angled front surface that faces upward and toward the front of the housing and an angled rear surface that faces upward and toward the rear of the housing, the angled front surface and the angled rear surface are positioned higher than the rotational axis of the main input gear and are positioned closer to the rear of the housing than the rotational axis of the main input gear is to the rear of the housing, the angled front surface and the angled rear surface are positioned higher than the bottom surfaces of the third and fourth alignment guides.

3. The toner cartridge of claim 2, wherein the third alignment guide is aligned with the engagement member along the front-to-rear dimension of the housing and the fourth alignment guide is spaced toward the rear of the housing from the engagement member.

4. The toner cartridge of claim 2, wherein the engagement member includes a horizontal surface at a peak of the engagement member positioned between the angled front surface and the angled rear surface.

5. The toner cartridge of claim 1, further comprising:

a channel running along the front of the housing between the first side and the second side in fluid communication with the outlet port, at least a portion of the channel is open to the reservoir; and an auger positioned in the channel and extending along the front of the housing between the first side and the second side, the auger is rotatably connected to the main input gear to move toner in the channel toward the outlet port when the main input gear rotates in an operative direction, wherein the first and second alignment guides are aligned with the channel in the vertical dimension of the housing.

6. The toner cartridge of claim 1, further comprising a fifth alignment guide that extends outward from the first side of the housing, the fifth alignment guide includes a front surface and a top surface that are unobstructed to permit the front surface of the fifth alignment guide to provide a forward stop and the top surface of the fifth alignment guide to provide an upward rotational stop when the toner cartridge is installed in the image forming device, the fifth alignment guide is positioned lower than the third and fourth alignment guides, the fifth alignment guide is spaced toward the rear of the housing from the third alignment guide.

7. The toner cartridge of claim 6, wherein the fifth alignment guide is positioned higher than the first and second alignment guides.

8. A toner cartridge for use in an electrophotographic image forming device, comprising:

a housing having a top, a bottom, a front and a rear positioned between a first side and a second side of the housing, the housing has a reservoir for holding toner;

an outlet port in fluid communication with the reservoir and facing downward on the front of the housing for exiting toner from the toner cartridge;

a toner delivery system for transferring toner from the reservoir out of the outlet port that includes a main input gear for providing rotational power to the toner delivery system, a top portion of the main input gear is exposed at the first side of the housing for mating with a corresponding drive gear in the image forming device when the toner cartridge is installed in the image forming device, the main input gear includes a rotational axis;

a first alignment guide that extends outward from the second side of the housing and runs along a front-to-rear dimension of the housing, the first alignment guide includes a bottom surface that is unobstructed to permit the bottom surface of the first alignment guide to sit on top of a corresponding first guide surface in the image forming device to control a vertical position of the toner cartridge when the toner cartridge is installed in the image forming device;

a second alignment guide and a third alignment guide that extend outward from the first side of the housing, the second alignment guide is spaced toward the front of the housing from the third alignment guide, each of the second alignment guide and the third alignment guide includes a respective bottom surface that is unobstructed to permit the respective bottom surfaces of the second and third alignment guides to sit on top of a corresponding second guide surface in the image forming device to control the vertical position of the toner cartridge when the toner cartridge is installed in the image forming device, the bottom surface of the second alignment guide is aligned with the bottom surface of the third alignment guide in a vertical dimension of the housing, the bottom surfaces of the second and third alignment guides are positioned higher than the first alignment guide, the bottom surfaces of the second and third alignment guides are positioned higher than the rotational axis of the main input gear and are positioned closer to the rear of the housing than the rotational axis of the main input gear is to the rear of the housing; and a fourth alignment guide that extends outward from the first side of the housing, the fourth alignment guide includes a front surface and a top surface that are unobstructed to permit the front surface of the fourth alignment guide to provide a forward stop and the top surface of the fourth alignment guide to provide an upward rotational stop when the toner cartridge is installed in the image forming device, the fourth alignment guide is positioned lower than the second and third alignment guides, the fourth alignment guide is spaced toward the rear of the housing from the second alignment guide.

9. The toner cartridge of claim 8, further comprising an engagement member on the first side of the housing, the engagement member includes an angled front surface that faces upward and toward the front of the housing and an angled rear surface that faces upward and toward the rear of the housing, the angled front surface and the angled rear surface are positioned higher than the rotational axis of the main input gear and are positioned closer to the rear of the housing than the rotational axis of the main input gear is to the rear of the housing, the angled front surface and the angled rear surface are positioned higher than the bottom surfaces of the second and third alignment guides.

10. The toner cartridge of claim 9, wherein the second alignment guide is aligned with the engagement member along the front-to-rear dimension of the housing and the third alignment guide is spaced toward the rear of the housing from the engagement member.

11. The toner cartridge of claim 9, wherein the engagement member includes a horizontal surface at a peak of the engagement member positioned between the angled front surface and the angled rear surface.

12. The toner cartridge of claim 8, further comprising a fifth alignment guide that extends outward from the first side of the housing and runs along the front-to-rear dimension of the housing, the fifth alignment guide is parallel to and aligned in the vertical dimension of the housing with the first alignment guide.

13. The toner cartridge of claim 12, further comprising:

a channel running along the front of the housing between the first side and the second side in fluid communication with the outlet port, at least a portion of the channel is open to the reservoir; and an auger positioned in the channel and extending along the front of the housing between the first side and the second side, the auger is rotatably connected to the main input gear to move toner in the channel toward the outlet port when the main input gear rotates in an operative direction, wherein the first and fifth alignment guides are aligned with the channel in the vertical dimension of the housing.

14. The toner cartridge of claim 12, wherein the fourth alignment guide is positioned higher than the first and fifth alignment guides.

15. A toner cartridge for use in an electrophotographic image forming device, comprising:

a housing having a top, a bottom, a front and a rear positioned between a first side and a second side of the housing, the housing has a reservoir for holding toner;

an outlet port in fluid communication with the reservoir and facing downward on the front of the housing for exiting toner from the toner cartridge;

a toner delivery system for transferring toner from the reservoir out of the outlet port that includes a main input gear for providing rotational power to the toner delivery system, a top portion of the main input gear is exposed at the first side of the housing for mating with a corresponding drive gear in the image forming device when the toner cartridge is installed in the image forming device, the main input gear includes a rotational axis;

an engagement member on the first side of the housing, the engagement member includes an angled front surface that faces upward and toward the front of the housing and an angled rear surface that faces upward and toward the rear of the housing, the angled front surface and the angled rear surface are unobstructed from the top to receive a hold down force when the toner cartridge is installed in the image forming device, the angled front surface and the angled rear surface are positioned higher than the rotational axis of the main input gear and are positioned closer to the rear of the housing than the rotational axis of the main input gear is to the rear of the housing; and a first alignment guide and a second alignment guide that extend outward from the first side of the housing, the first alignment guide is spaced toward the front of the housing from the second alignment guide, each of the first alignment guide and the second alignment guide includes a respective bottom surface that is unobstructed to permit the respective bottom surface to sit on top of a corresponding guide surface in the image forming device to control a vertical position of the toner cartridge when the toner cartridge is installed in the image forming device, the bottom surface of the first alignment guide is aligned with the bottom surface of the second alignment guide in a vertical dimension of the housing, the bottom surfaces of the first and second alignment guides are positioned higher than the rotational axis of the main input gear and are positioned closer to the rear of the housing than the rotational axis of the main input gear is to the rear of the housing, the bottom surfaces of the first and second alignment guides are positioned lower than the angled front surface and the angled rear surface of the engagement member, the second alignment guide is spaced toward the rear of the housing from the engagement member.

16. The toner cartridge of claim 15, wherein the engagement member includes a horizontal surface at a peak of the engagement member positioned between the angled front surface and the angled rear surface.

17. The toner cartridge of claim 15, wherein the first alignment guide is aligned with the engagement member along a front-to-rear dimension of the housing.

18. The toner cartridge of claim 15, further comprising:

a third alignment guide that extends outward from the first side of the housing and runs along a front-to-rear dimension of the housing;

a fourth alignment guide that extends outward from the second side of the housing and runs along the front-to-rear dimension of the housing, the fourth alignment guide is parallel to and aligned in the vertical dimension of the housing with the third alignment guide, wherein the bottom surfaces of the first and second alignment guides are positioned higher than the third and fourth alignment guides.

19. The toner cartridge of claim 18, further comprising:

a channel running along the front of the housing between the first side and the second side in fluid communication with the outlet port, at least a portion of the channel is open to the reservoir; and an auger positioned in the channel and extending along the front of the housing between the first side and the second side, the auger is rotatably connected to the main input gear to move toner in the channel toward the outlet port when the main input gear rotates in an operative direction, wherein the third and fourth alignment guides are aligned with the channel in the vertical dimension of the housing.

20. The toner cartridge of claim 15, further comprising a third alignment guide that extends outward from the first side of the housing, the third alignment guide includes a front surface and a top surface that are unobstructed to permit the front surface of the third alignment guide to provide a forward stop and the top surface of the third alignment guide to provide an upward rotational stop when the toner cartridge is installed in the image forming device, the third alignment guide is positioned lower than the first and second alignment guides, the third alignment guide is spaced toward the rear of the housing from the first alignment guide.

21. A toner cartridge for use in an electrophotographic image forming device, comprising:

a housing having a top, a bottom, a front and a rear positioned between a first side and a second side of the housing, the housing has a reservoir for holding toner;

an outlet port in fluid communication with the reservoir and facing downward on the front of the housing for exiting toner from the toner cartridge;

a toner delivery system for transferring toner from the reservoir out of the outlet port that includes a main input gear for providing rotational power to the toner delivery system, a top portion of the main input gear is exposed at the first side of the housing for mating with a corresponding drive gear in the image forming device when the toner cartridge is installed in the image forming device, the main input gear includes a rotational axis;

an engagement member on the first side of the housing, the engagement member includes an angled front surface that faces upward and toward the front of the housing and an angled rear surface that faces upward and toward the rear of the housing, the angled front surface and the angled rear surface are unobstructed from the top to receive a hold down force when the toner cartridge is installed in the image forming device, a peak of the engagement member positioned between the angled front surface and the angled rear surface is positioned higher than a topmost portion of the main input gear and is positioned closer to the rear of the housing than the rotational axis of the main input gear is to the rear of the housing;

a first alignment guide that extends outward from the first side of the housing, the first alignment guide includes a bottom surface that is unobstructed to permit the bottom surface of the first alignment guide to sit on top of a corresponding guide surface in the image forming device to control a vertical position of the toner cartridge when the toner cartridge is installed in the image forming device, the bottom surface of the first alignment guide is positioned higher than the rotational axis of the main input gear and is positioned closer to the rear of the housing than the rotational axis of the main input gear is to the rear of the housing, the bottom surface of the first alignment guide is positioned lower than the peak of the engagement member; and a second alignment guide that extends outward from the first side of the housing, the second alignment guide includes a front surface and a top surface that are unobstructed to permit the front surface of the second alignment guide to provide a forward stop and the top surface of the second alignment guide to provide an upward rotational stop when the toner cartridge is installed in the image forming device, the second alignment guide is positioned lower than the first alignment guide, the second alignment guide is spaced toward the rear of the housing from the engagement member.

22. The toner cartridge of claim 21, further comprising a third alignment guide that extends outward from the first side of the housing, the first alignment guide is spaced toward the front of the housing from the third alignment guide, the third alignment guide includes a bottom surface that is unobstructed to permit the bottom surface of the third alignment guide to sit on top of the corresponding guide surface in the image forming device to control the vertical position of the toner cartridge when the toner cartridge is installed in the image forming device, the bottom surface of the first alignment guide is aligned with the bottom surface of the third alignment guide in a vertical dimension of the housing, the bottom surface of the third alignment guide is positioned closer to the rear of the housing than the rotational axis of the main input gear is to the rear of the housing, the third alignment guide is spaced toward the rear of the housing from the engagement member.

23. The toner cartridge of claim 22, wherein the first alignment guide is aligned with the engagement member along a front-to-rear dimension of the housing.

24. The toner cartridge of claim 21, wherein the engagement member includes a horizontal surface at the peak of the engagement member.

25. The toner cartridge of claim 21, further comprising:

a third alignment guide that extends outward from the first side of the housing and runs along a front-to-rear dimension of the housing;

a fourth alignment guide that extends outward from the second side of the housing and runs along the front-to-rear dimension of the housing, the fourth alignment guide is parallel to and aligned in a vertical dimension of the housing with the third alignment guide, wherein the bottom surface of the first alignment guide is positioned higher than the third and fourth alignment guides.

26. The toner cartridge of claim 25, further comprising:

a channel running along the front of the housing between the first side and the second side in fluid communication with the outlet port, at least a portion of the channel is open to the reservoir; and an auger positioned in the channel and extending along the front of the housing between the first side and the second side, the auger is rotatably connected to the main input gear to move toner in the channel toward the outlet port when the main input gear rotates in an operative direction, wherein the third and fourth alignment guides are aligned with the channel in the vertical dimension of the housing.

27. The toner cartridge of claim 25, wherein the second alignment guide is positioned higher than the third and fourth alignment guides.

28. The toner cartridge of claim 21, wherein the second alignment guide is positioned closer to the rear of the housing than the first alignment guide is to the rear of the housing.

* * * * *